US010045584B2

(12) United States Patent
Gentry

(10) Patent No.: US 10,045,584 B2
(45) Date of Patent: Aug. 14, 2018

(54) THERAPEUTIC SHOE INSERT

(71) Applicant: NystAssist, LLC, Gastonia, NC (US)

(72) Inventor: John R. Gentry, Gastonia, NC (US)

(73) Assignee: NYSTASSIST, LLC, Gastonia, NC (US)

( * ) Notice: Subject to any disclaimer, the term of this patent is extended or adjusted under 35 U.S.C. 154(b) by 278 days.

(21) Appl. No.: 14/933,374

(22) Filed: Nov. 5, 2015

(65) Prior Publication Data

US 2016/0128422 A1 May 12, 2016

Related U.S. Application Data

(60) Provisional application No. 62/076,918, filed on Nov. 7, 2014.

(51) Int. Cl.

| | |
|---|---|
| ***A43B 7/14*** | (2006.01) |
| ***A43B 17/10*** | (2006.01) |
| ***A43B 17/00*** | (2006.01) |
| ***A41B 11/00*** | (2006.01) |

(52) U.S. Cl.

CPC ..... *A43B 7/1405* (2013.01); *A41B 11/006* (2013.01); *A41B 11/007* (2013.01); *A43B 7/1455* (2013.01); *A43B 17/003* (2013.01); *A43B 17/006* (2013.01); *A43B 17/105* (2013.01); *A41B 2400/324* (2013.01)

(58) Field of Classification Search

CPC ..... A43B 17/00; A43B 17/003; A43B 17/006; A43B 17/105; A43B 7/1455; A43B 7/1405; A43B 11/006

See application file for complete search history.

(56) References Cited

U.S. PATENT DOCUMENTS

| | | | | | |
|---|---|---|---|---|---|
| 1,219,890 | A * | 3/1917 | West | A43B 7/142 | 36/3 B |
| 1,537,848 | A * | 5/1925 | MacDonald | A43B 23/086 | 12/146 C |
| 2,100,492 | A * | 11/1937 | Sindler | A43B 13/20 | 12/146 BR |
| 5,165,183 | A * | 11/1992 | Huang | A43B 3/106 | 36/11.5 |
| 5,606,807 | A * | 3/1997 | Prepodnik | A43B 1/06 | 36/11.5 |
| 5,799,415 | A * | 9/1998 | Kenji | A43B 17/08 | 36/3 R |
| 6,640,465 | B1 * | 11/2003 | Burgess | A43B 7/141 | 36/15 |
| 2005/0034328 | A1 * | 2/2005 | Geer | A43B 3/0036 | 36/30 R |

* cited by examiner

*Primary Examiner* — Jila M Mohandesi

(74) *Attorney, Agent, or Firm* — Boyle Fredrickson, S.C.

(57) ABSTRACT

An insole constructed of paper provides a periodic somatosensory stimulation to the sole of the foot thought to provide therapeutic benefit with respect to medical conditions related to the functioning of the nervous system. A corrugated upper paper layer may contact the skin directly and absorb and disperse perspiration. Low cost allows a kit to be provided of insoles each providing a different stimulation pattern for rotation over the week.

3 Claims, 4 Drawing Sheets

THERAPEUTIC SHOE INSERT

CROSS REFERENCE TO RELATED APPLICATION

This application claims the benefit of U.S. provisional application 62/076,918 filed Nov. 7, 2014, and hereby incorporated by reference in its entirety.

BACKGROUND OF THE INVENTION

The present invention relates to a therapeutic shoe insole and method of use.

There arc preliminary indications that applying pressure to various surfaces of the body can aid in treating a variety of medical conditions that relate to function of the nervous system. While the theory is not well developed, these pressure points may provide for stimulation of the somatosensory system providing beneficial or counter stimulant action to other nerve signals.

The sole of the foot provides a potentially important surface for such somatosensory stimulation because of the presence of many nerve endings.

SUMMARY OF THE INVENTION

The present invention provides an insole that may be used to provide a variety of different somatosensory stimulation to the sole of the foot of possible clinical benefit. In particular, the invention provides an insole constructed of paper material providing the benefits of a natural material that may contact the skin directly, that may absorb and disperse perspiration, and that can be fabricated at low cost in a variety of forms to allow for the use of multiple different stimulating patterns at different times.

Specifically, in one embodiment, the invention provides a therapeutic insole having a first substantially flat paper layer sized to fit against a sole of a foot to substantially follow a contact surface of the foot against the ground in the manner of an insole. A second corrugated paper layer conforming to the periphery of the first substantially flat paper layer is adhered to an upper surface of the first substantially flat paper layer at troughs of the corrugations on the lower surface of the second corrugated paper layer to expose peaks of the corrugation to a foot resting on the second corrugated paper layer. The corrugations provide stimulation to the sole of a foot of greater than 10 hertz.

it is thus one feature of at least one embodiment of the invention to provide a simple element for somatosensory stimulation easily incorporated into an individual's daily life and constructed of low-cost and natural materials.

The corrugations may extend along a lateral axis generally perpendicular to a longitudinal axis running along the length of the insole from a toe portion to a heel portion.

It is thus one feature of at least one embodiment of the invention to provide a corrugation angle that tends to provide a sequential somatosensory stimulation to the sole of a foot at approximately 10 hertz during walking.

The therapeutic insole corrugations that extend at an angle with respect to the lateral axis or may be aligned with the lateral axis, may be substantially linear or may follow a serpentine path along a plane of extent of the second paper layer.

It is thus one feature of at least one embodiment of the invention to provide a variety of different stimulation patterns such as may be useful for preventing acclimation.

The second paper layer may include a plurality of holes cut through its surface to promote the passage of air therethrough.

it is thus one feature of at least one embodiment of the invention to provide a stimulating insole that may accommodate direct contact with the foot while dissipating perspiration.

The second paper layer maybe treated with a material selected from the group consisting of a natural desiccant and an antioxidant.

It is thus one feature of at least one embodiment of the invention to provide natural desiccants perforations to reduce moisture buildup.

The therapeutic insole may include straps attached to the first paper layer for receiving a foot therethrough to hold the sole of the foot against the upper surface of the second paper layer.

It is thus one feature of at least one embodiment of the invention to provide an extremely low-cost stimulation system that does not presuppose particular shoe sizes or use.

Alternatively, the therapeutic insole may include a. sock of woven material for fitting over the foot retaining the upper surface of the second paper layer against the sole of the foot.

It is thus one feature of at least one embodiment of the invention to provide for foot contact without the need for straps or the like.

The therapeutic insole may further include a third substantially flat paper layer attached at its bottom surface to the second corrugated paper layer to cover only portions of the second corrugated paper layer and a fourth corrugated paper layer coextensive with the third substantially flat paper layer and adhered to an upper surface of the third substantially flat paper layer at troughs of the corrugations on the lower surface of the fourth corrugated paper layer to expose peaks of the corrugation to a foot resting on the fourth corrugated paper layer.

it is thus one feature of at least one embodiment of the invention to provide two spatial frequencies of stimulation to accommodate different patterns of rolling contact between the foot and the insole to ensure a proper frequency of stimulation.

The corrugations of the second corrugated paper layer and fourth corrugated paper layer may extend along parallel axes.

It is thus one feature of at least one embodiment of the invention to provide stimulation patterns that augment each other as one walks.

In one embodiment, the therapeutic insole may further include a rib structure providing laterally extending ribs attached to a lower surface of the first substantially flat paper layer.

It is thus one feature of at least one embodiment of the invention to provide a simple way of augmenting the stimulation pattern of the second paper layer without the need for multiple laminated constructions.

Generally it is contemplated that the low cost and simple construction of the invention will make practical a kit of insoles constructed as described above where different insoles have corrugations to provide different patterns.

It is thus one feature of at least one embodiment of the invention to prevent acclimation by an individual to the stimulation pattern by providing variation in that stimulation pattern over time.

These particular objects and advantages may apply to only some embodiments falling within the claims and thus do not define the scope of the invention.

DETAILED DESCRIPTION OF THE PREFERRED EMBODIMENT

Figure 1:
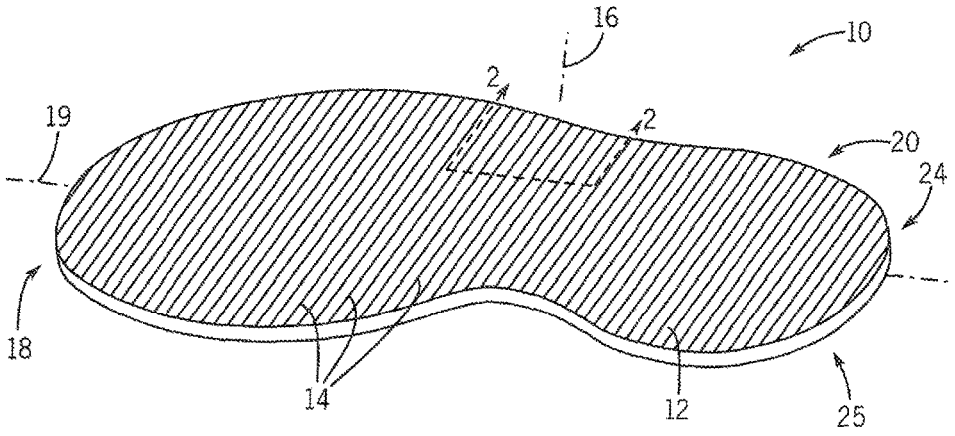
FIG. 1 is a perspective view of an insole constructed according to the present invention providing a corrugated insole having exposed corrugation ridges.
Figure 2:
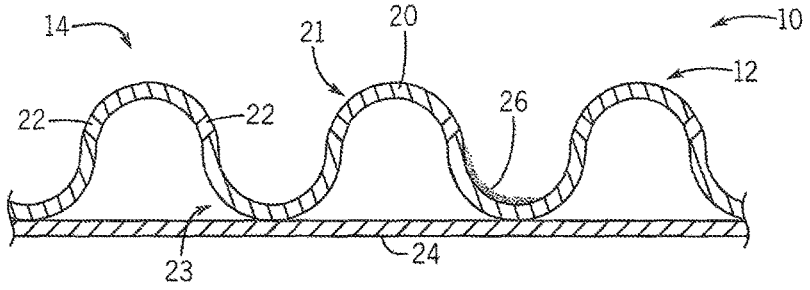
FIG. 2 is a cross-section taken along line 2-2 of FIG. 1 showing the assembly of the insole from a flat and corrugated paper layer.

Referring now to FIGS. 1 and 2, an insole 10 of the present invention may provide for an upper surface 12 having a set of periodic ripples 14 extending along a lateral axis 16 generally perpendicular to a longitudinal axis 19 running along the length of the insole from a toe portion 18 to a heel portion 25. The periodic ripples 14 may for example, following a sinusoidal curve extending along the longitudinal axis 19 and then sweeping that curve along the lateral axis 16 across the upper surface 12 to define a rippled plane. The periodic ripples 14, in one embodiment, may provide for a periodicity of 2.8 cycles or ridge crests 21 per centimeter with the amplitude of one millimeter. Generally a range between 1 and 5 ridge crests per centimeter are contemplated. Ideally, the periodic ripples 14 are such as to generate a 10 hertz or greater signal to the brain by flexing back and forth against the sole of the foot during walking when the foot is placed against the upper surface 12 in the manner of a conventional insole.

In one embodiment, the periodic ripples 14 will comprise an exposed corrugated paper layer 20 folded in the manner of corrugations used for reinforced cardboard and may have multiple holes 22 passing through this corrugated paper layer 20 to help dissipate perspiration. The under surface of the corrugated paper layer 20 may be attached, for example, at troughs 23 of the ripples 14 by glue or the like, to an upper surface of a planar cardboard layer 24, the latter to provide for resistance against flattening of the ripples 14 in the corrugated paper layer 20 by tensioning against expansion of the ripples 14. Generally the corrugated paper layer 20 and planar cardboard layer 24 have the same outline in peripheries, following generally the curve shape of contact of a human foot with a horizontal surface during walking in the manner of a standard insole. As will be understood from the description below, the planar cardboard layer 24 may distort slightly and may be considered truly planar only with respect to the corrugated paper layer 20.

The paper products of corrugated paper layer 20 and planar cardboard layer 24 may include a coating material 26 such as magnesium powder, bee propolis or another powdered antioxidant to decrease stress and inflammation in the brain and body. Alternative antioxidants including myrrh as well as frankincense may also be used.

In one embodiment, a woven cloth material such as a sock may be placed over the ripples 14 between the ripples 14 and a person's foot to provide additional cushioning and absorption. Alternatively a standard foot sock could be attached to the bottom of the cardboard by putting Velcro on the upper surface of the corrugated paper layer 20 and on the lower surface of the sock.

Figure 3:
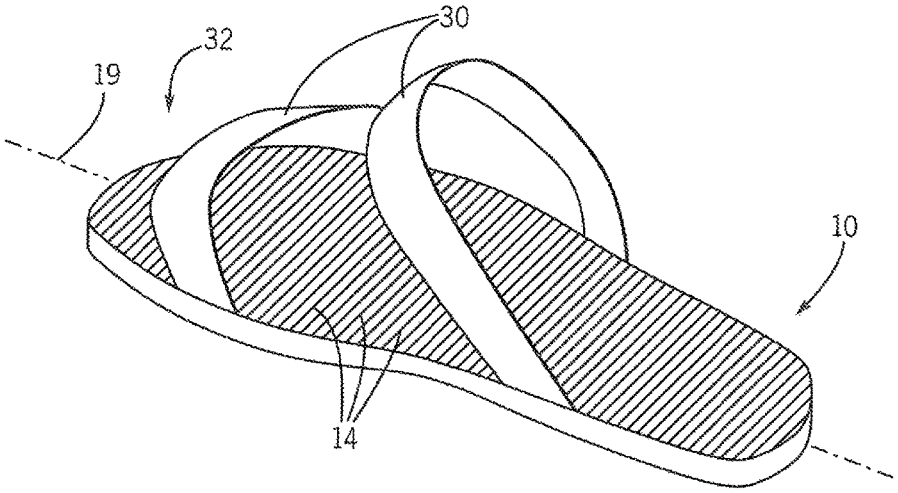
FIG. 3 is a perspective view of a sandal constructed using the present invention as both the insole and sole.
Figure 4:
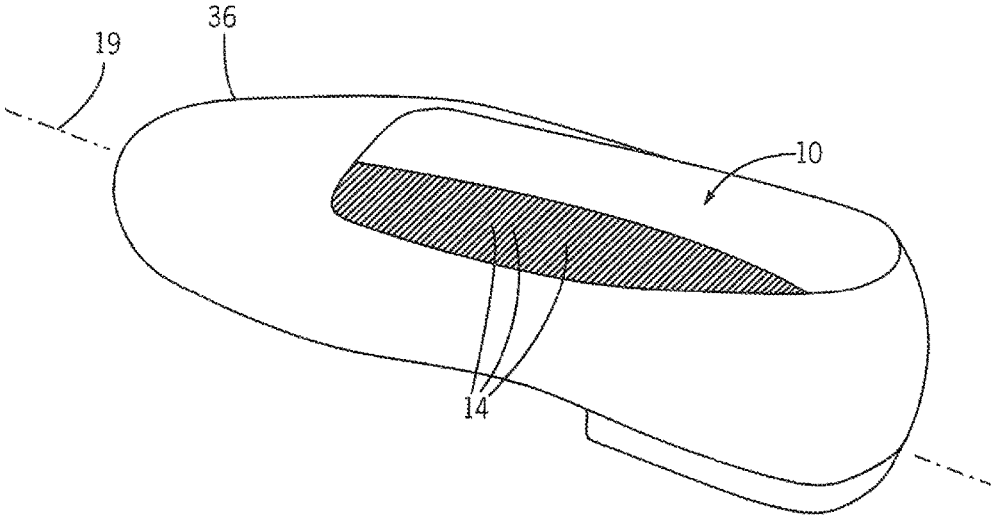
FIG. 4 is a perspective view similar to that of FIG. 3 showing use of the invention as an insole in a conventional shoe.

Referring now to FIG. 3, a lightweight therapeutic device may make use of the insole 10 comprising materials of paper layers 20 and 24 attached to foot straps 30 that may pass over the top of the user's foot. These straps retain the insole 10 against the soles of the user's feet during walking to make the insole into a lightweight sandal 32. Referring to FIG. 4, alternatively, a standard shoe 36 may receive the insole 10 into the shoe to replace or to supplement the standard insole provided with the shoe 36.

Figure 5:
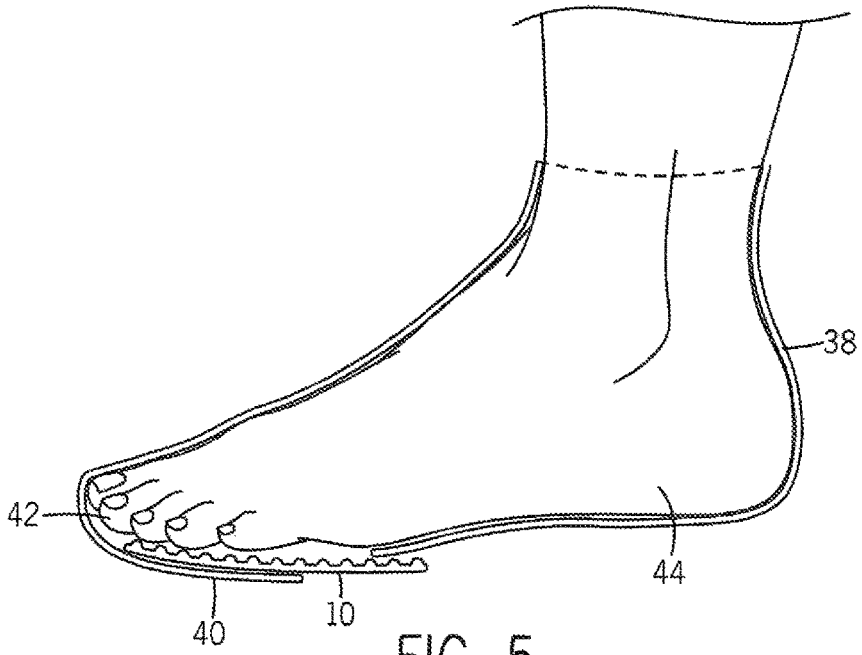
FIG. 5 is an elevational cross-section of a sock providing a pocket for holding an insole of the present invention.

Referring to FIG. 5, a sock 38 may be constructed to have a pocket 40 with an open backside on the bottom surface of the sock 38 normally contacting the sole of the foot. The pocket 40, for example, is constructed by a slight overlapping of material of the bottom of the sock 38 or in the manner of a patch pocket over an opening that would otherwise expose the foot. The pocket 40 may receive the insole 10 within the pocket to be exposed to the toes 42 and front of the foot 44 of the user wearing the sock 38 to the surface of the insole 10.

Figure 6:
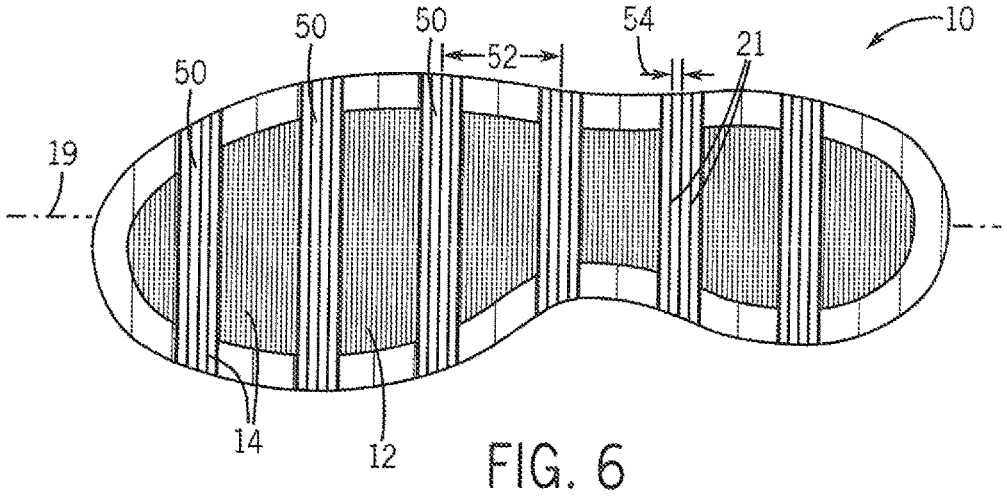
FIG. 6 is a top plan view of an alternative construction of the insole of FIG. 1 having laminated corrugated elements.

Referring now to FIG. 6, the present invention may be used to provide for several frequencies of sensory stimulation by providing two different structures producing two additive stimulation frequencies. The first structure may be the exposed upper surface 12 described above and the second structure may be overlying laminated elements 50 periodically spaced at a second stimulation spatial frequency 52 along the longitudinal axis 19. These laminated elements 50 may be constructed of corrugated material similar to that shown in FIG. 2 having crests 21 at the first stimulation spatial frequency 54. The first stimulation frequency may, for example, be on the order of a few sixteenths of an inch while the second stimulation spatial frequency 52 may be on the order of 1 to 2 inches. The laminated elements 50 are spaced apart to expose the ripples 14 of the upper surface 12 of the insole of FIG. 1 and provide corresponding ripples 14 thereon.

Figure 7:
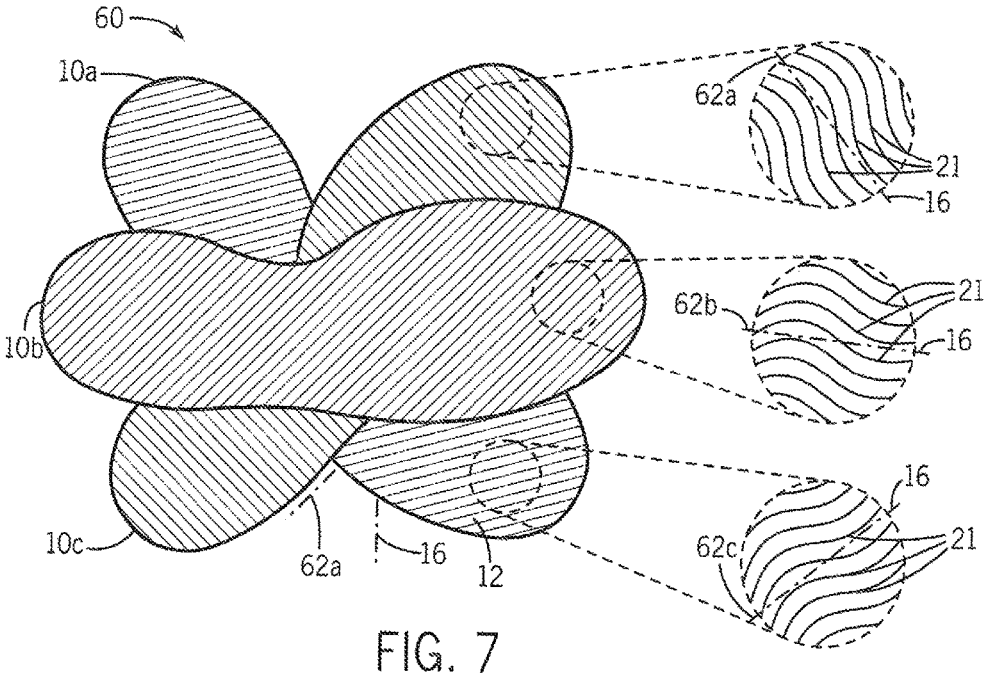
FIG. 7 is a top plan view of a kit providing a set of insoles providing different stimulation patterns and employing serpentine corrugations shown in enlarged details.

Referring now to FIG. 7, it is believed that variation in the stimulation pattern, for example, during the day or between different days, may be necessary to prevent acclimation by the nervous system. Accordingly, the present invention contemplates a kit 60 comprised of multiple pairs of insoles 10 (only one insole for each pair shown for clarity) wherein the stimulation pattern on the upper surface of the insoles 10 is varied with respect to shape, spatial repetition frequency, amplitude or the like. Accordingly, a first insole **10*a* may provide for an upper surface having serpentine ripples 14 following a generally sinusoidal path along an axis 62*a*, for example, at a 15-degree angle 64*a* with respect to the lateral axis 16. A second insole 10*b* may provide for ripples 14 along axis 62*b* aligned with lateral axis 16 while a third insole 10*c* may provide for an upper surface having serpentine ripples 14 following a sinusoidal path along axis 62*c* tipped with respect to lateral axis 16 in the opposite direction as that of axis 62*a***. In use, different insoles would be used at different times.

Figure 8:
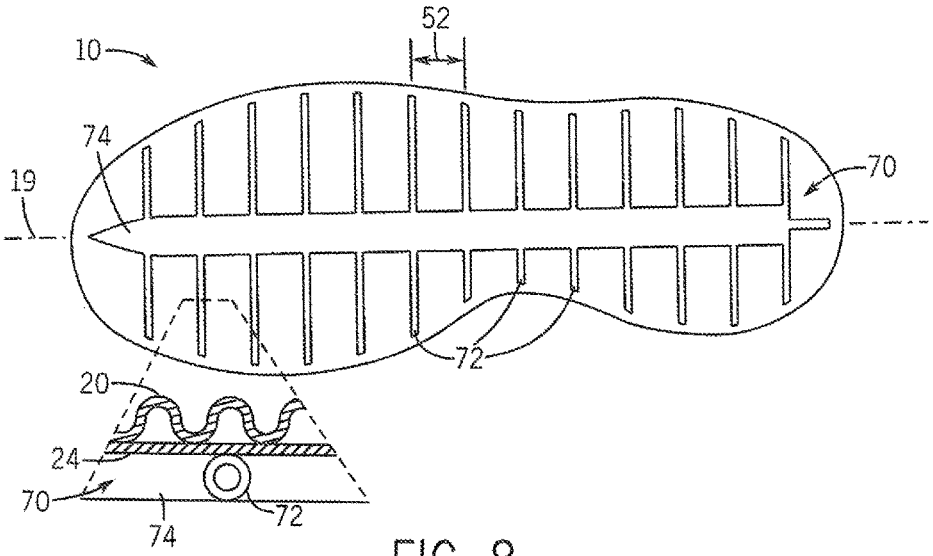
FIG. 8 is a bottom plan view of the sole FIG. 1 in an embodiment including a set of spine supports providing an augmenting lower spatial frequency stimulation pattern.

Referring no to FIG. 8, the juxtaposition of two different spatial stimulation frequencies applied on the sole of the foot may also be accomplished through the use of the spine structure 70 which may be placed beneath the planar cardboard layer 24 with respect to the foot. The spine structure 70, for example, may be molded from a plastic material or the like but desirably may be constructed from natural cardboard or a similar material, for example, die cut laminated as appropriate. The spine structure 70 provides for multiple ribs 72 extending laterally from a central spine 74, the spine 74 being aligned generally along the longitudinal axis 19. Each of the ribs 72 operate to slightly distort the paper layers 24 and 20 at the second stimulation spatial frequency 52 to provide a lower frequency stimulation periodicity to the walker when used with insole 10 such as that shown in FIG. 1. Ribs 72 may be adhered to the bottom of the planar cardboard layer 24.

While the inventor does not wish to be bound to a particular theory, it is believed that the insole 10 enables the toes to generate a 10 Hz or greater signal to the brain by flexing back and forth against the ridges of the insert so that different crests 21 of the paper layer 20 are successively brought into contact with the foot in a rolling progression. In contrast, a massage shoe lacks the fine detail to send this many vibrations per second to the brain. The massage shoe can only transmit pressure and low frequency pressure waves (0-1 Hz) associated with walking. Corrugated paper enables the user through the Meisner cells in the foot to send signals of 10 to 50 Hz to the brain.

Generally it is believed that the insole 10 may have a variety of different benefits not limited to those discussed above but also including assistance with respect to the conditions of nystagmus, Alzheimer's, Parkinson's, Tourette's, concussion, chronic traumatic encephalopathy, emotional trauma, and PTSD specifically since these involve theta beta ratio, With regard to this latter effect, U.S. application publication 2014/0012152, Ser. No. 13720104 filed Dec. 19, 2012, by the same inventor is hereby incorporated in its entirety by reference.

The present principles may also be applied to a walkway providing a corrugated walking path or to a psychology tablet which makes use of haptic stimuli from a phone or computer tablet in order to achieve a neurological end. Sliding the bare or socked foot over a corrugated walking path can help the brain generate the smooth motor reflex signals necessary for walking and balance.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

The term paper is used herein refers to nonwoven materials constructed primarily of cellulosic fibers for example derived from organic material such as wood pulp or plant fiber.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein arc not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained, herein and the claims should be understood to include modified forms of those embodiments including portions of the embodiments and combinations of dements of different embodiments as come within the scope of the following claims All of the publications described herein, including patents and non-patent publications are hereby incorporated herein by reference in their entireties.

What I claim is:

1. A therapeutic insole comprising:

a first substantially flat paper layer sized to fit against a sole of a foot to substantially follow a contact surface of the foot against the ground in a manner of an insole;

a second corrugated paper layer conforming to a periphery of the first substantially flat paper layer and adhered to an upper surface of the first substantially flat paper layer at troughs of corrugations on a lower surface of the second corrugated paper layer to expose peaks of the corrugations to a foot resting on the second corrugated paper layer; and wherein the corrugations provide stimulation to a sole of a foot in contact with the insole during walking of greater than 10 hertz;

further including a rib structure providing laterally extending ribs and attached to a lower surface of the first substantially flat paper layer.

2. The therapeutic insole of claim 1 wherein the rib structure further includes a spine portion extending along a longitudinal axis running along a length of the insole from a toe portion to a heel portion.

3. The therapeutic insole of claim 1 wherein the ribs and spine have a cross-section of at least one millimeter.

* * * * *